US006948349B2

(12) United States Patent
Gorski et al.

(10) Patent No.: US 6,948,349 B2
(45) Date of Patent: Sep. 27, 2005

(54) RAIN GUTTER ROLL FORMING MACHINE WITH INDEPENDENT ADJUSTMENTS

(75) Inventors: Michael Gorski, Sayreville, NJ (US); Bruce E. Meyer, Arvada, CO (US)

(73) Assignee: Englert, Inc., Perth Amboy, NJ (US)

( * ) Notice: Subject to any disclaimer, the term of this patent is extended or adjusted under 35 U.S.C. 154(b) by 97 days.

(21) Appl. No.: 10/677,638

(22) Filed: Oct. 2, 2003

(65) Prior Publication Data

US 2005/0072202 A1 Apr. 7, 2005

(51) Int. Cl.[7] ..... B21D 5/08
(52) U.S. Cl. ..... 72/181
(58) Field of Search ..... 72/181, 182, 179

(56) References Cited

U.S. PATENT DOCUMENTS 2,826,235 A * 3/1958 Gudmestad ..... 72/124
3,529,461 A * 9/1970 Knudson ..... 72/181
4,899,566 A * 2/1990 Knudson ..... 72/129
5,491,998 A * 2/1996 Hansen ..... 72/181
5,664,451 A * 9/1997 Schultz ..... 72/181
5,740,687 A * 4/1998 Meyer et al. ..... 72/131
6,439,020 B1 * 8/2002 Baschnagel et al. ..... 72/181
6,766,676 B2 * 7/2004 Gorski ..... 72/181

* cited by examiner

*Primary Examiner*—Daniel C. Crane
(74) *Attorney, Agent, or Firm*—David L. Davis

(57) ABSTRACT

A roll forming machine for a debris shedding rain gutter having a lower trough and an upper hood, wherein independent adjustments are made to the front wall of the trough to insure that its upper edge is behind the forward end of the trough. An independently adjustable kick forming station is provided to create an inward bend near the upper end of the front wall. A block is adjustably mounted to a cross-member of the machine to press the front wall inwardly to insure that the angle where the front wall joins the bottom wall of the trough is approximately ninety degrees.

4 Claims, 7 Drawing Sheets

RAIN GUTTER ROLL FORMING MACHINE WITH INDEPENDENT ADJUSTMENTS

BACKGROUND OF THE INVENTION

This invention relates to a roll forming machine which produces a rain gutter of indeterminate length and, more particularly, to such a machine wherein an adjustment can be made to a particular portion of the profile of the rain gutter in an independent manner without affecting the remainder of the profile.

Roll forming machines are well known in the home building and remodeling industry. Such a machine is typically mounted on the bed of a pickup truck, van, trailer, or the like, so that it can be transported to, and used at, the site where siding panels, roofing panels and rain gutters are to be installed. Typically, such a machine comprises a series of spaced forming stations, each having upper and lower shaping rollers between which a sheet metal strip is passed, so as to impart a desired shape to the sheet metal strip, which is uniform along the length of the sheet metal strip after it exits the machine. Different combinations of rollers provide different lateral profiles to the strip. Conventionally, each machine is designed to provide a single predetermined lateral profile to the sheet metal strip. In order to make an adjustment to a particular portion of the profile, usually the entire station forming that portion of the profile needs to be moved. A need therefore exists to have an arrangement whereby adjustments can be made independently without involving an entire station.

U.S. Pat. No. 4,757,649 discloses a debris shedding rain gutter which is formed by a roll forming machine. This gutter includes a lower trough and an upper hood, with the lower trough including a back wall and a front wall joined to a bottom wall. When redesigning this gutter to a larger size, it was found that certain adjustments were critical to insure that the upper edge of the front wall of the trough is behind the forward end of the hood. It would be desirable to design the roll forming machine so that the end user could easily make the critical adjustments independently without making other adjustments to the relevant forming stations.

SUMMARY OF THE INVENTION

According to the present invention, there is provided a roll forming machine of the type which forms an indeterminate length debris shedding rain gutter of a desired lateral profile from a uniform width supply strip of sheet metal having a pair of parallel straight edges. The roll forming machine defines a predetermined path of travel for the supply strip through a plurality of roll forming stations and the desired lateral profile includes a lower trough and an upper hood, with the lower trough including a back wall and a front wall joined to a bottom wall. The machine includes an arrangement for selectively providing independent adjustment of the profile at at least one predetermined one of the plurality of roll forming stations. The arrangement comprises a pair of kick forming rollers mounted to a bracket at the entry to a first selected roll forming station and adapted to provide an inward bend near the upper end of the front wall so that the upper edge of the front wall is behind the forward end of the hood, wherein the bracket is independently adjustably mounted to the roll forming machine. The arrangement further comprises a block adjustably mounted to the roll forming machine at a second selected roll forming station where there is a first roller in contact with the exterior of the back wall of the trough and a second roller in contact with the exterior of the bottom wall of the trough, wherein the block slidingly engages the front wall of the trough to form a substantially right angle where the front wall joins the bottom wall, and wherein the block is independently adjustable toward and away from the first roller.

In accordance with an aspect of this invention, the pair of kick rollers is arranged to provide a bend of about twenty degrees.

In accordance with another aspect of this invention, the roll forming machine includes a horizontal bracket extending across the second selected roll forming station, the horizontal bracket is formed with three through-bores arranged along a straight line and with the center through-bore being internally threaded, the block is mounted to the horizontal bracket by two threaded bolts extending through respective ones of the two outer through-bores, and adjustment of the block is provided by a third threaded member threadedly engaging the center through-bore and having an end engaging an upper surface of the block.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
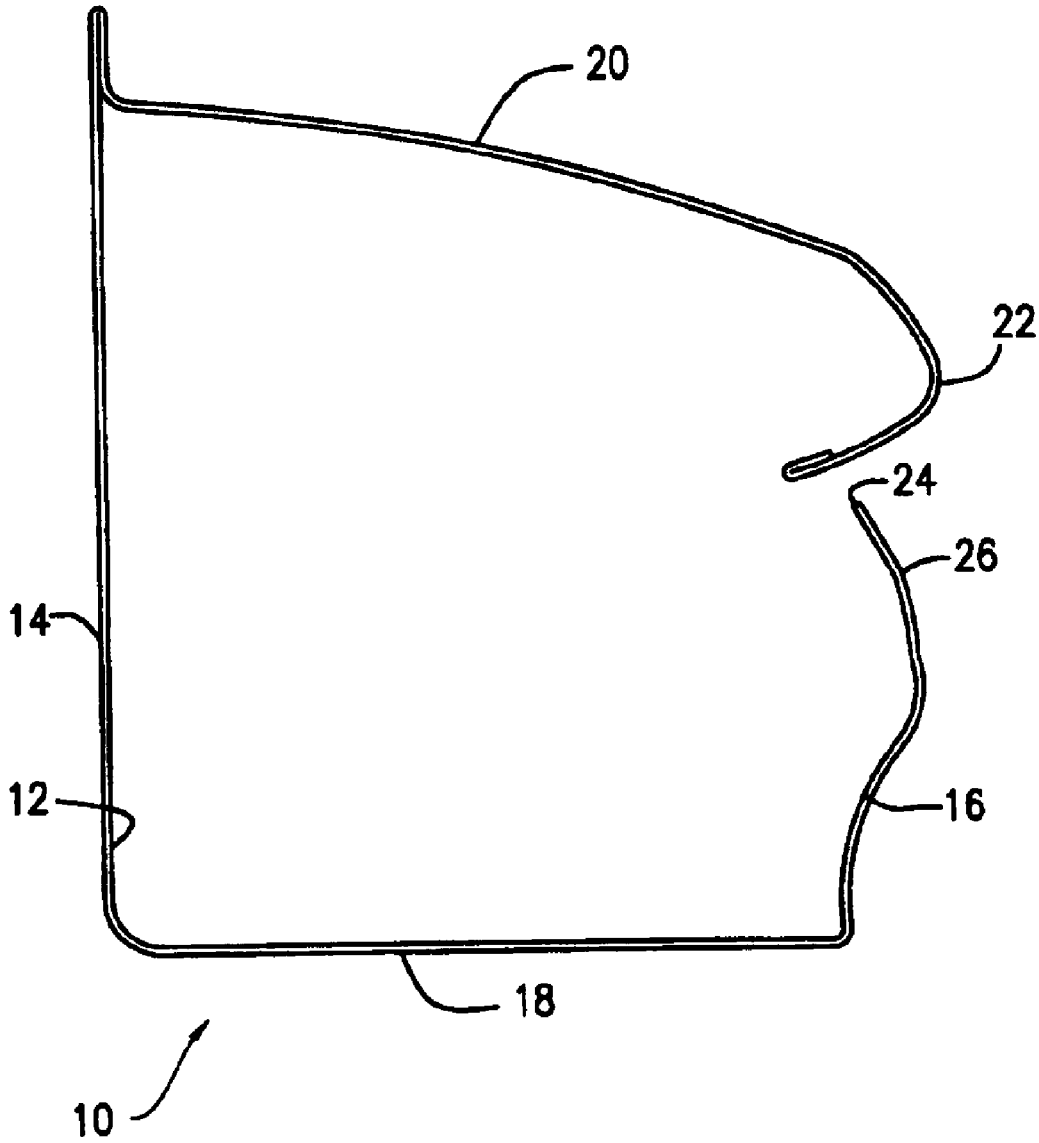
FIG. 1 shows the lateral profile of an illustrative debris shedding rain gutter produced by a roll forming machine having incorporated therein improvements according to the present invention.

Referring now to the drawings, FIG. 1 shows the lateral profile of a debris shedding rain gutter, designated generally by the reference numeral 10, which it is desired to be formed by a roll forming machine. The gutter 10 includes a lower trough 12 having a back wall 14 and a front wall 16 joined to a bottom wall 18. The gutter 10 also includes an upper hood 20 extending from the back wall 14 and terminated by a bullnose 22 at its forward end. What is critical, when forming the gutter 10, is that the upper edge 24 of the front wall 16 is behind the forward end of the bullnose 22 so that debris sliding downwardly along the upper hood 20 does not pass into the trough 12. To accomplish this, the present invention provides independently adjustable arrangements at two locations within the roll forming machine to ensure that the angle where the front wall 16 joins the bottom wall 18 is approximately ninety degrees and to provide an approximately twenty degrees inward bend, or kick, 26 in the front wall 16 below the upper edge 24.

Figure 2A:
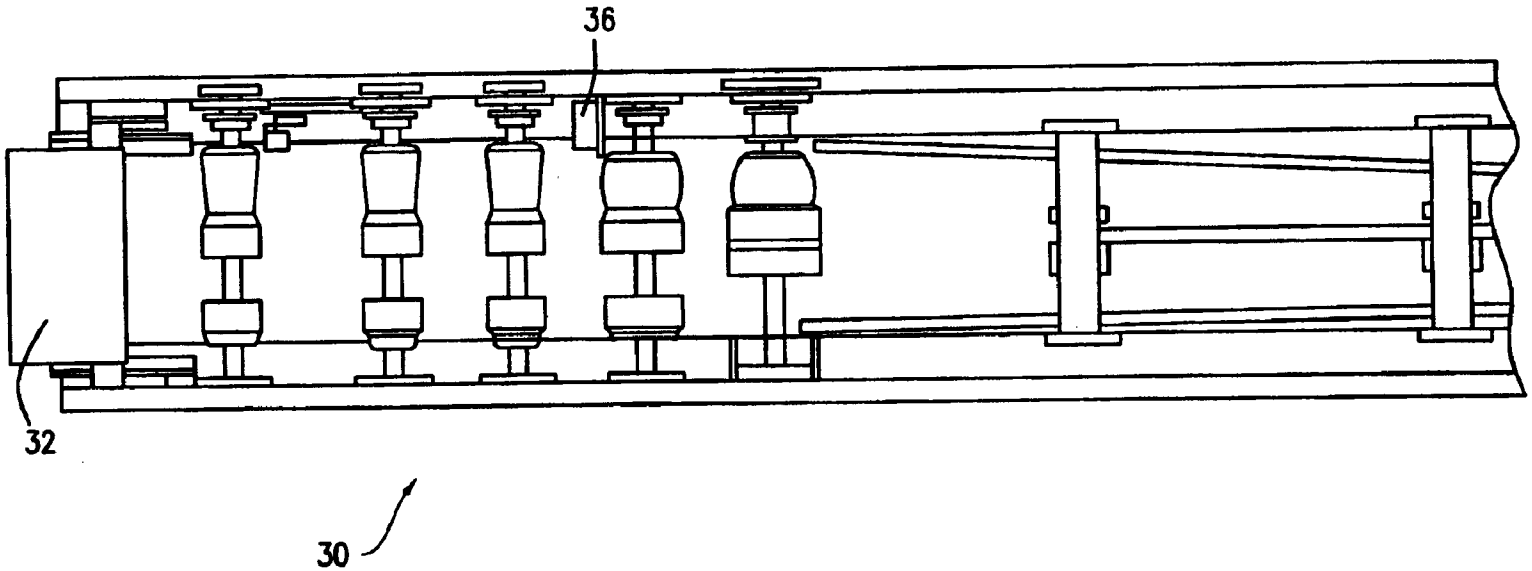
FIGS. 2A and 2B, with FIG. 2A placed to the left of FIG. 2B, together are a schematic top plan view of an improved roll forming machine for producing a gutter having the lateral profile shown in FIG. 1.
Figure 2B:
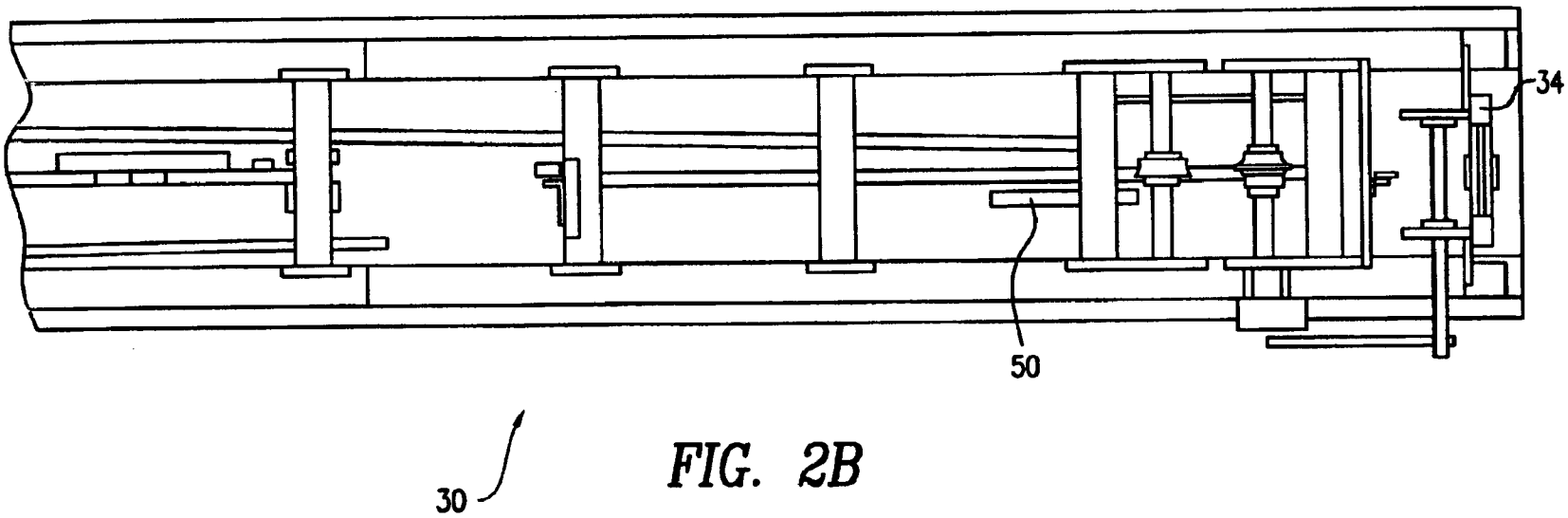

FIGS. 2A and 2B schematically show a roll forming machine, designated generally by the reference numeral 30, in which the present invention is incorporated. As is conventional in the roll forming art, a uniform width supply strip of sheet metal having a pair of parallel straight edges is provided in the form of a coil 32 at the entry end of the machine 30. The sheet metal strip is pulled by drive rollers through a succession of roll forming stations which impart the desired lateral profile to the strip. At the exit end of the machine 30, a cutting station 34 is activated to cut the formed strip to the desired length.

Figure 3:
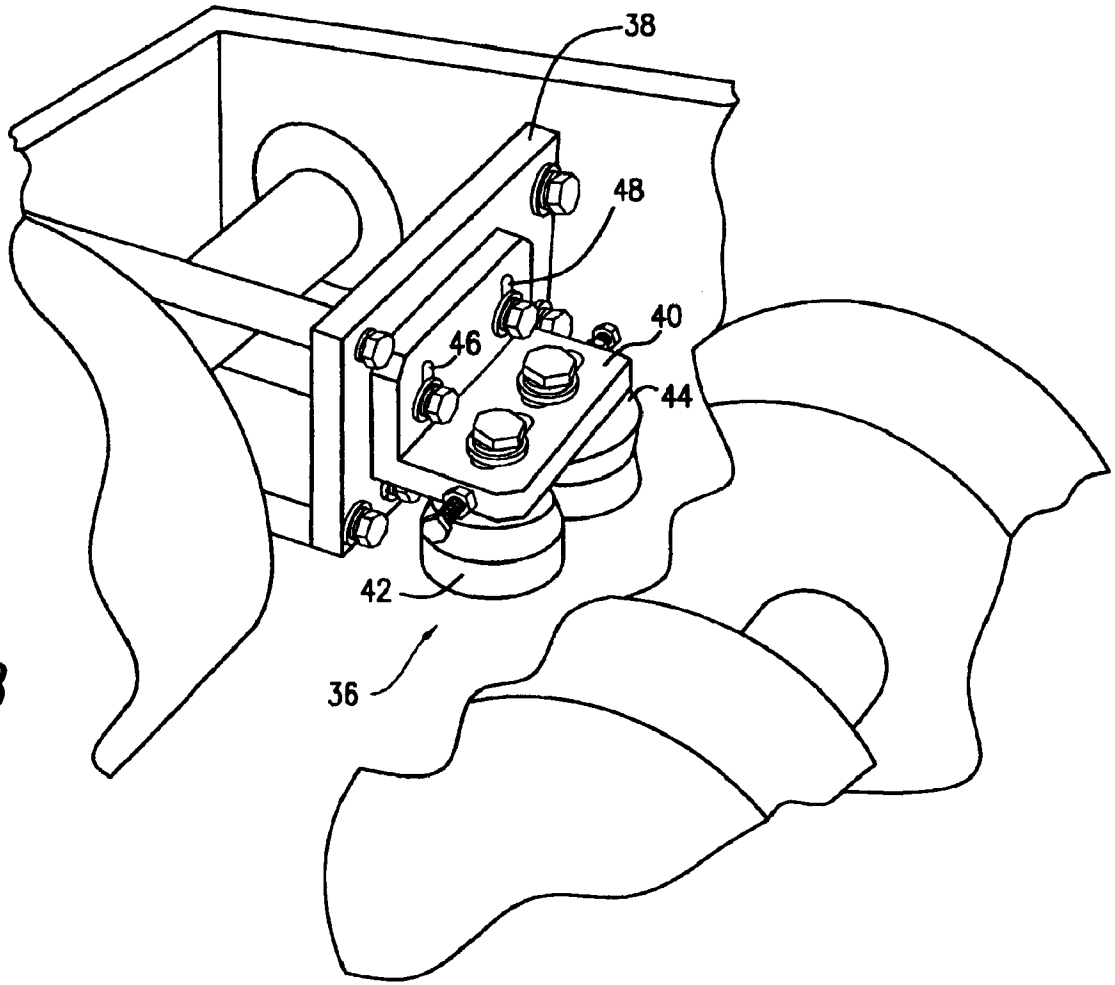
FIG. 3 is a top perspective view showing the pair of kick forming rollers adjustably mounted according to the present invention.
Figure 4:
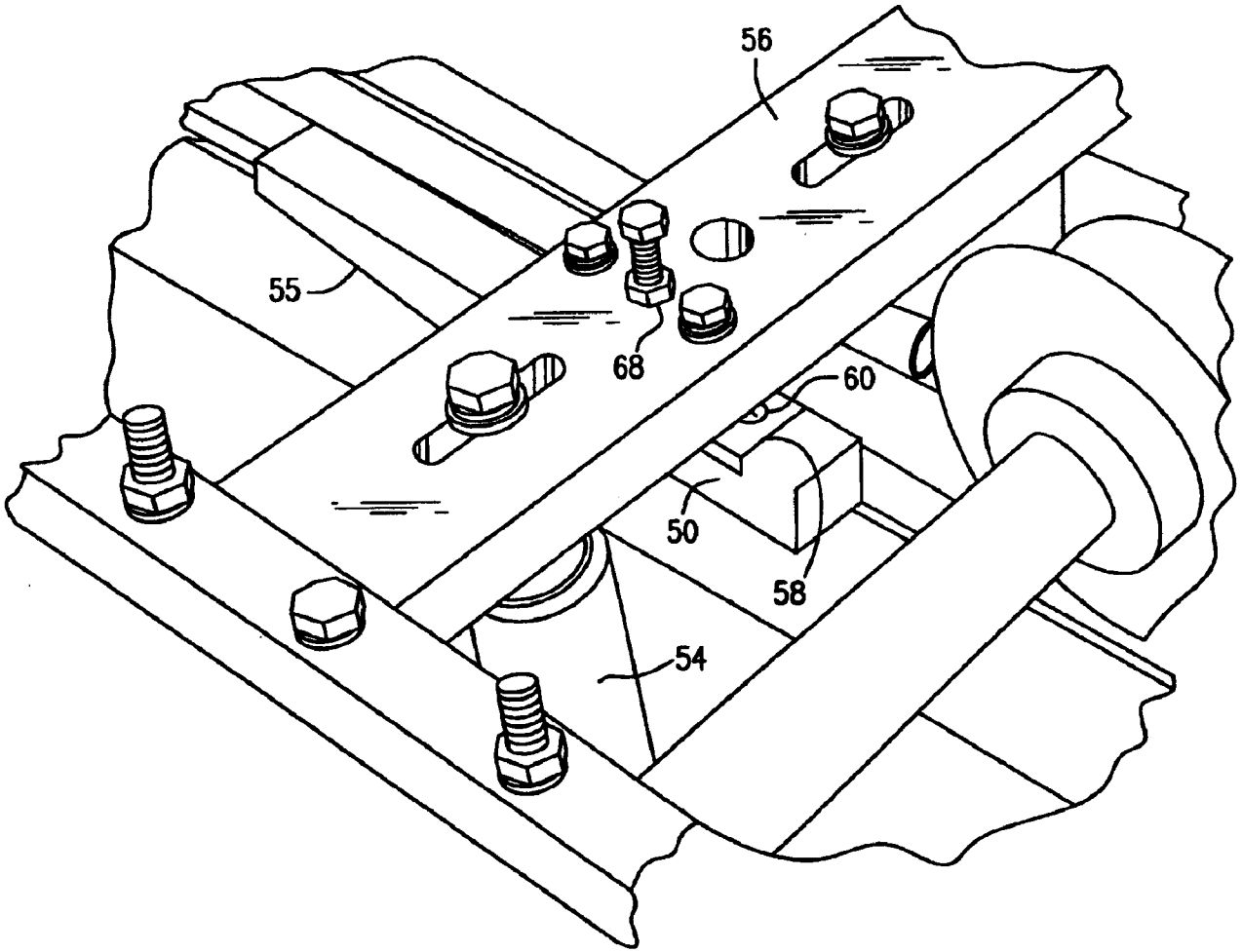
FIG. 4 is a top perspective view showing the adjustably mounted block according to the present invention.

According to the present invention, to form the bend, or kick, 26 there is incorporated in the roll forming machine 30 a kick station 36. As shown in FIG. 3, the kick station 36 is advantageously mounted to a bracket plate 38 which is pre-existing in the machine 30 at the entry to a particular roll forming station after the front wall 16 has been formed. The kick station 36 includes an angle bracket 40 mounted to the bracket plate 38 and a pair of forming rollers 42,44 rotatably mounted to the angle bracket 40. The rollers 42,44 are designed to provide the twenty degrees inward bend 26 to the front wall 16 of the gutter 10 approximately one-half inch below the upper edge 24 of the front wall 16. To provide independent adjustability so that the bend 26 is properly positioned on the front wall 16, the angle bracket 40 is formed with vertically oriented elongated mounting slots 46,48 to enable the kick station 36 to be independently adjusted without disturbing the alignment of any other portion of the machine 30.

Figure 5:
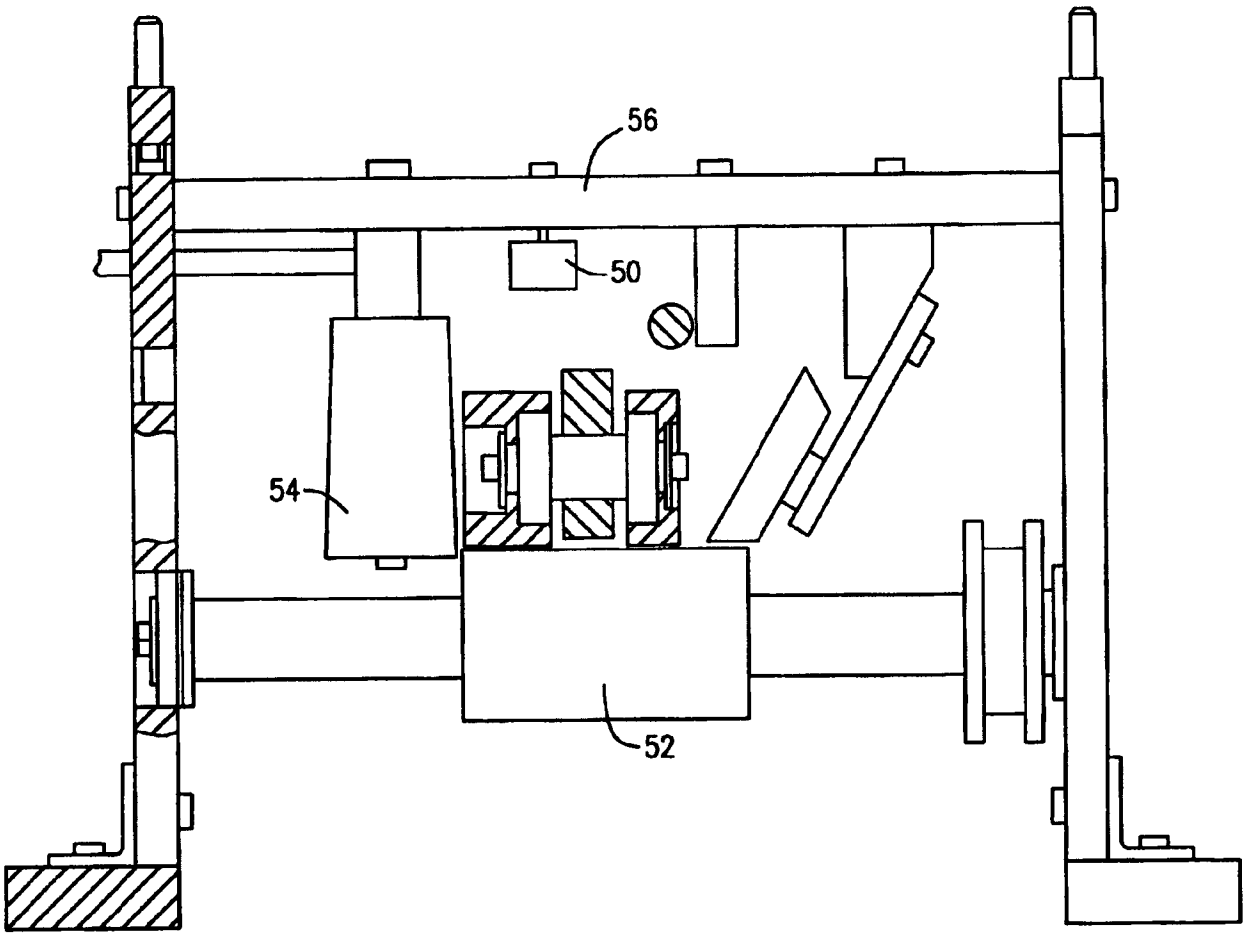
FIG. 5 is a schematic cross sectional view showing the roll forming station at which the block shown in FIG. 4 is mounted.

To ensure that the angle where the front wall 16 joins the bottom wall 18 is approximately ninety degrees, there is provided an adjustably mounted nylon block 50 near the exit end of the roll forming machine 30. The block 50 is arranged to press down on the front wall 16 at a roll forming station where the exterior of the back wall 14 is supported by the roller 52 (FIG. 5) and the exterior of the bottom wall 18 is prevented from moving outwardly by the roller 54. The block 50 is substantially rectilinear in shape, with a bevel 55 at its leading end to insure that the front wall 16 passes underneath the block 50. According to the present invention, the block 50 is mounted to the cross-member, or bracket, 56 in an independently adjustable manner, in contrast to previous mounting arrangements where the block 50 was fixedly secured to the cross-member 56 and adjustment of the block 50 was effected by moving the entire cross-member 56, which then required realignment of all the rollers mounted to the cross-member 56.

Figure 6:
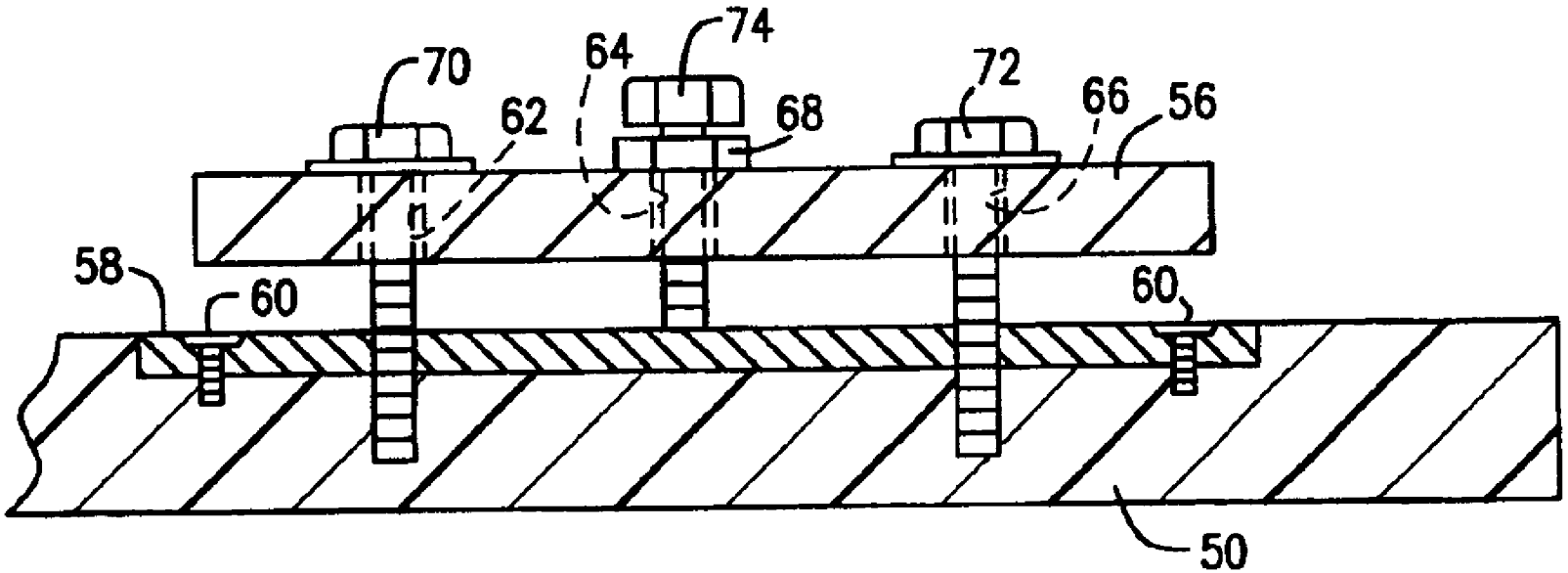
FIG. 6 is a partial cross sectional view showing the adjustable mounting of the block shown in FIG. 4, according to the present invention.

As shown in FIG. 6, the block 50 has an aluminum plate 58 installed in a recess provided therefor in the top surface of the block 50. The plate 58 is held in place by the screws 60. To mount the block 50, the cross-member 56 is formed with three through-bores 62,64,66 arrayed along a straight line. The outer two through-bores 62,66 have smooth interiors and the center through-bore 64 is internally threaded. Alternatively, the center through-bore 64 may also have a smooth interior and an internally threaded nut 68 may be welded to the cross-member 56 in alignment with the through-bore 66, but the end result will be the same. A pair of threaded bolts 70,72 extends through the outer through-bores 62,66, respectively, and into the block 50 to secure the block 50 to the cross-member 56. A third threaded bolt 74 threadedly engages the center through-bore 64 (or the nut 68) and bears against the upper surface of the plate 58 to set the position of the block 50 relative to the cross-member 56. The bolts 70,72 are then tightened to hold the block 50 securely. In the event adjustments to the block 50 have to be made, the bolts 70,72 are loosened, the bolt 74 is adjusted, and the bolts 70,72 are tightened. Thus, all adjustments to the block 50 are effected independently without requiring realignment of any other portion of the machine 30.

Accordingly, there has been disclosed a rain gutter roll forming machine wherein independent adjustment to a particular portion of the lateral profile of the rain gutter is effected without affecting the remainder of the profile. While an illustrative embodiment of the present invention has been disclosed, it is understood that various modifications to, and adaptations of, the disclosed embodiment are possible without departing from the spirit of this invention. It is therefore intended that this invention be limited only by the scope of the appended claims.

What is claimed is:

1. In a roll forming machine of the type which forms an indeterminate length debris shedding rain gutter of a desired lateral profile from a uniform width supply strip of sheet metal having a pair of parallel straight edges, said roll forming machine defining a predetermined path of travel for said supply strip through a plurality of roll forming stations, wherein the desired lateral profile includes a lower trough and an upper hood, with the lower trough including a back wall and a front wall joined to a bottom wall, an arrangement for selectively providing independent adjustment of said profile at at least one predetermined one of said plurality of roll forming stations, the arrangement comprising:

a pair of kick forming rollers mounted to a bracket at the entry to a first selected roll forming station and adapted to provide an inward bend near an upper end of the front wall so that an upper edge of the front wall is behind a forward end of the hood, wherein the bracket is independently adjustably mounted to the roll forming machine; and a block adjustably mounted to the roll forming machine at a second selected roll forming station where there is a first roller in contact with the exterior of the back wall of the trough and a second roller in contact with the exterior of the bottom wall of the trough, wherein the block slidingly engages the front wall of the trough to form a substantially right angle where the front wall joins the bottom wall, and wherein the block is independently adjustable toward and away from the first roller.

2. The arrangement according to claim 1, wherein the pair of kick forming rollers is arranged to provide a bend of about twenty degrees.

3. The arrangement according to claim 1, wherein the bracket includes a pair of vertically oriented elongated mounting slots so that the position of the inward bend on the front wall is selectively adjustable.

4. The arrangement according to claim 1, wherein:

the roll forming machine includes a horizontal bracket extending across the second selected roll forming station;

the horizontal bracket is formed with three through-bores arranged along a straight line and with the center through-bore being internally threaded;

the block is mounted to the horizontal bracket by two threaded bolts extending through respective ones of the two outer through-bores and into the block; and adjustment of the block is provided by a third threaded member threadedly engaging the center through-bore and having an end engaging an upper surface of the block.

* * * * *